US006670891B2

(12) United States Patent
Jamet et al.

(10) Patent No.: US 6,670,891 B2
(45) Date of Patent: Dec. 30, 2003

(54) MAGNETIC DETECTOR OF VEHICLE WHEELS

(75) Inventors: Michel Jamet, Bures sur Yvette (FR); Patrice Lefevre, Villejust (FR)

(73) Assignee: Atoll Technology, Orsay (FR)

( * ) Notice: Subject to any disclaimer, the term of this patent is extended or adjusted under 35 U.S.C. 154(b) by 178 days.

(21) Appl. No.: 09/858,495

(22) Filed: May 16, 2001

(65) Prior Publication Data

US 2002/0105441 A1 Aug. 8, 2002

(30) Foreign Application Priority Data

Feb. 8, 2001 (FR) ..... 01 01715

(51) Int. Cl.[7] ..... G08G 1/01
(52) U.S. Cl. ..... 340/933; 340/941
(58) Field of Search ..... 340/933, 941; 324/207.11, 207.13, 207.15, 207.22

(56) References Cited

U.S. PATENT DOCUMENTS

| | | | | |
|---|---|---|---|---|
| 5,408,179 A | | 4/1995 | Sampey et al. | 324/253 |
| 5,614,894 A | * | 3/1997 | Stanczyk | 340/933 |
| 6,208,268 B1 | * | 3/2001 | Scarzello et al. | 340/941 |

FOREIGN PATENT DOCUMENTS

| | | |
|---|---|---|
| FR | 2 639 438 | 5/1990 |
| GB | 2 096 810 | 10/1982 |

* cited by examiner

*Primary Examiner*—Thomas Mullen
(74) *Attorney, Agent, or Firm*—Duane Morris LLP

(57) ABSTRACT

A magnetic detector of the passing of at least one vehicle wheel, a sensor of which is intended for being positioned on or in a roadway, and includes a conductive winding of at least one spiral and a ferrite structure inscribed in an elongated surface area, the conductive element being wound around a portion of the ferrite structure, parallel to its greater dimension.

9 Claims, 3 Drawing Sheets

MAGNETIC DETECTOR OF VEHICLE WHEELS

BACKGROUND OF THE INVENTION

1. Field of the Invention

The present invention relates to detectors of the passing of vehicles' axles a sensor of which is positioned in a roadway. Such detectors are used, for example, to count the vehicles driving on a road or in association with a tollgate to automatically count the number of axles of a vehicle arriving at the barrier.

2. Discussion of the Related Art

A first family of detectors uses the mechanical crushing under the effect of the vehicle weight to sense the passing of an axle. Such detectors are, for example, mechanical, piezoelectric or optical detectors.

A second detector family avoids wearing problems associated with mechanical stress and uses the magnetic signature of a vehicle. More specifically, a winding is buried in the roadway and is excited by an A.C. reference frequency signal. The passing of a vehicle above the winding causes a variation in the magnetic field which translates as a variation of the signal frequency in the winding. The frequency variations can then be monitored to detect the passing of vehicles.

FIG. 1 shows in a very simplified top view a roadway 1 equipped with a magnetic detector of the passing of vehicles. This detector is essentially formed of a winding 3 buried in roadway 1, approximately perpendicular to the traffic direction. Both ends of winding 3 are connected to an excitation and measurement device 4 including, among others, an oscillator for exciting winding 3 and means for measuring a variation of the signal frequency in the winding.

A problem which arises with conventional magnetic detectors is due to the metallic mass of the vehicle. Indeed, this metallic mass tends to disturb measurements or, at least, to make the detection of the vehicle axles particularly difficult.

To ease the counting or detection of axles, it has already been provided to take advantage of the existence of wire meshes in the tires of a vehicle's wheels. Such wire meshes are elements disturbing the magnetic field, which are very close to the roadway. However, the magnetic variations due to tires are disturbed by the rest of the metallic mass of the vehicle and by possible metallic structures in the roadway, which strongly alter the wanted signal-to-general signal ratio.

U.S. Pat. No. 5,614,894 provides for distinguishing the variations due to metallic masses from those due to the vehicle's tires based on the direction of magnetic field variation. The solution described in this document is, however, particularly complex to implement since the wanted signal-to-general signal ratio is extremely low due to the vehicle's metallic mass. In practice, the frequency variations to be measured are on the order of $10^{-6}$. Making such measurements reliable is particularly difficult.

Other magnetic detectors are described, for example, in documents WO-A-0,058,926 and WO-A-0,058,927.

SUMMARY OF THE INVENTION

The present invention aims at overcoming the disadvantages of known vehicle axle magnetic detectors.

The present invention more specifically aims at providing a novel magnetic detector of the passing of vehicle wheels which is no longer disturbed by the magnetic mass represented by the very vehicle.

The present invention also aims at providing a detector which is particularly simple to form and which is compatible with products currently available for sale.

The present invention also aims at providing a solution compatible with conventional exploitation circuits. In particular, the present invention aims at providing a detector which enables providing the same type of information as conventional detectors.

A feature of the present invention is to provide a concentration of the magnetic field of the coil buried in the roadway to prevent dispersal of the field lines towards the entire vehicle. More specifically, the present invention brings the size (width) of the detector winding down to the scale of the track of a vehicle wheel. For this purpose, the present invention provides associating with the sensor coil a ferrite structure. To fulfill the objective of bringing the size of the structure down to the scale of a wheel track, the winding and the ferrite structure are inscribed within an elongated surface which, moreover, is of large dimension (generally one or several meters long). A difficulty then is that the forming of an elongated ferrite structure of large dimension currently is difficult, or at least, relatively expensive. According to the present invention, small ferrite elements that are placed end to end in the large dimension of the structure to be obtained are preferably used. Standard ferrite elements, easily available for sale, can thus be used to form a structure of great length. To apply the present invention to magnetic sensors in roadways, the fact of providing a discontinuous ferrite structure (formed of elements of small size placed side by side) does not adversely affect the result.

More specifically, the present invention provides a magnetic sensor of the passing of at least one vehicle wheel adapted to being positioned on or in a roadway, including a conductive winding of at least one spiral and a ferrite structure inscribed in an elongated surface, the conductive element being wound around a portion of the ferrite structure, parallel to its greater dimension.

According to an embodiment of the present invention, the ferrite structure is positioned so that at least one air-gap is directed towards the roadway surface.

According to an embodiment of the present invention, the ferrite structure has an E-shaped cross-section, the conductive winding being wound around the central branch of the E.

According to an embodiment of the present invention, the ferrite structure has a U-shaped cross-section, the conductive winding being wound around the bottom of the U or on one of the sides.

According to an embodiment of the present invention, the ferrite structure has a length ranging between 2 and 10 cm and a length greater than 10 cm.

According to an embodiment of the present invention, the ferrite structure is formed of a succession of elements of small dimensions put end to end in the large dimension of the structure.

According to an embodiment of the present invention, the vehicle wheel magnetic detector includes a sensor of the above type and an excitation and measurement exploitation circuit.

According to an embodiment of the present invention, the circuit includes an oscillator tuned to the parameters at rest of the conductive winding associated with a capacitor, and a phase-locked loop, a voltage-controlled oscillator of which detects possible frequency variations in the rejector circuit formed of the conductive winding and of the capacitor.

According to an embodiment of the present invention, the excitation frequency of the rejector circuit ranges between 10 and 100 kHz.

The foregoing objects, features and advantages of the present invention, will be discussed in detail in the following non-limiting description of specific embodiments in connection with the accompanying drawings.

DETAILED DESCRIPTION

Figure 1:
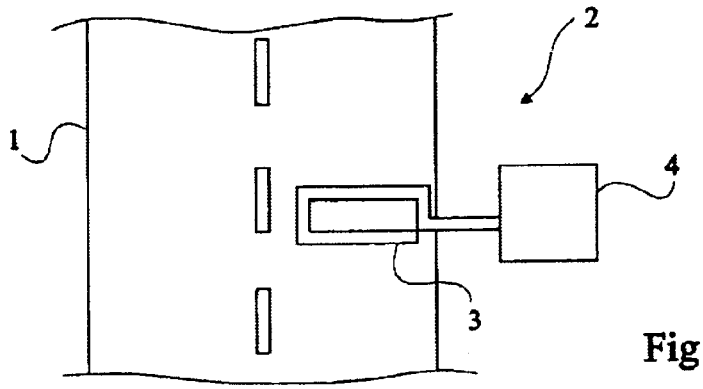
Fig 1 PRIOR ART
FIG. 1, previously described, very schematically shows a top view of a conventional vehicle magnetic detector.

The same elements have been designated with the same references in the different drawings. For clarity, only those elements of the magnetic sensor and of its excitation and exploitation circuit which are necessary to the understanding of the present invention have been shown in the drawings and will be described hereafter. In particular, the electronic excitation and measurement exploitation circuits, as well as the various counting devices, have not been shown and are no object of the present invention. The present invention applies whatever use is made of the measurements, provided that the at least partial purpose is to exploit a detection of vehicle wheels or axles.

Figure 2A:
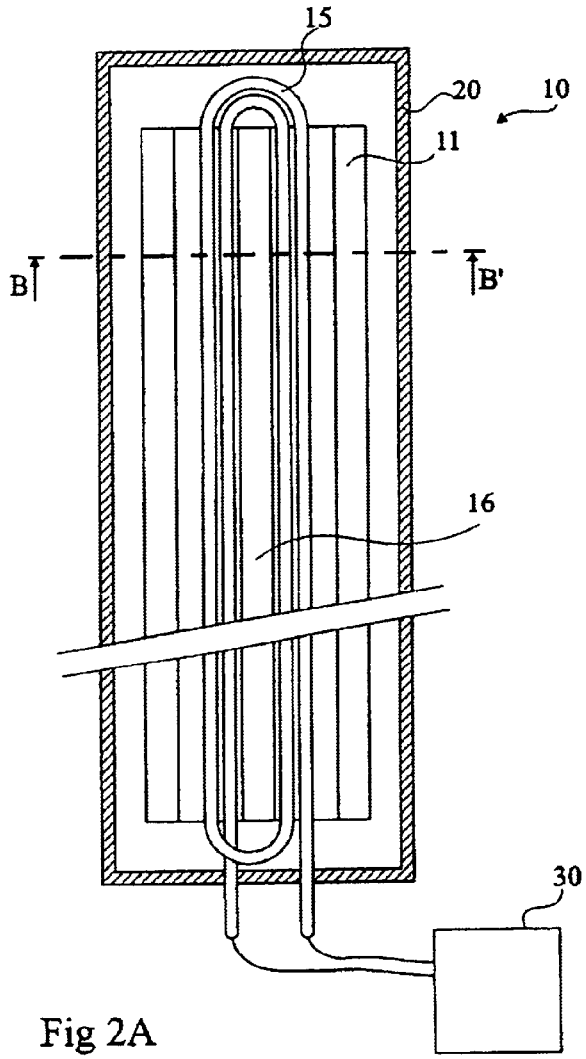
FIGS. 2A and 2B show, respectively in top view and in cross-section view along line B–B' of FIG. 2A, an embodiment of a magnetic sensor of the passing of vehicle wheels according to the present invention.
Figure 2B:
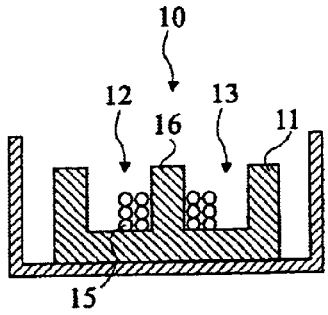

FIGS. 2A and 2B show, respectively in top view and in cross-section view along line B–B' of FIG. 2A, a magnetic sensor according to an embodiment of the present invention. Sensor 10 is formed of a ferrite structure 11 having a general elongated shape and concentrating an electromagnetic field towards the top of the sensor, that is, directed towards the roadway in which it is integrated (or on which it is laid). The active sensor surface is formed, in the embodiment of FIGS. 2A and 2B, of two parallel air-gaps 12 and 13 in the direction of the greater dimension of the sensor. Ferrite structure 11 encloses a winding 15 formed of a great number of spirals wound around a central armature 16 of the ferrite structure. The sensor formed of ferrite structure 11 and of winding 15 is enclosed in a protective sheathing 20, which is itself generally buried in the roadway. Sensor 10 is, conventionally, positioned substantially perpendicularly to the vehicle passing direction. In practice, the large dimension of the sensor may form an angle ranging between 20 and 90° with the vehicle displacement axis on the roadway.

In the embodiment of FIGS. 2A and 2B, the ferrite structure has, in cross-section, an E shape with a central branch forming armature 16 around which winding 15 is wound. Air-gaps 12 and 13 are closed up by the metallic armature (wire-mesh) of the tires as they pass above the sensor. This induces a variation of the excitation signal which is at rest before and after the wheel passing. To exploit the sensor signals, both ends of winding 15 are connected to an excitation and measurement exploitation device 30, an embodiment of which will be described in relation with FIG. 3.

Figure 3:
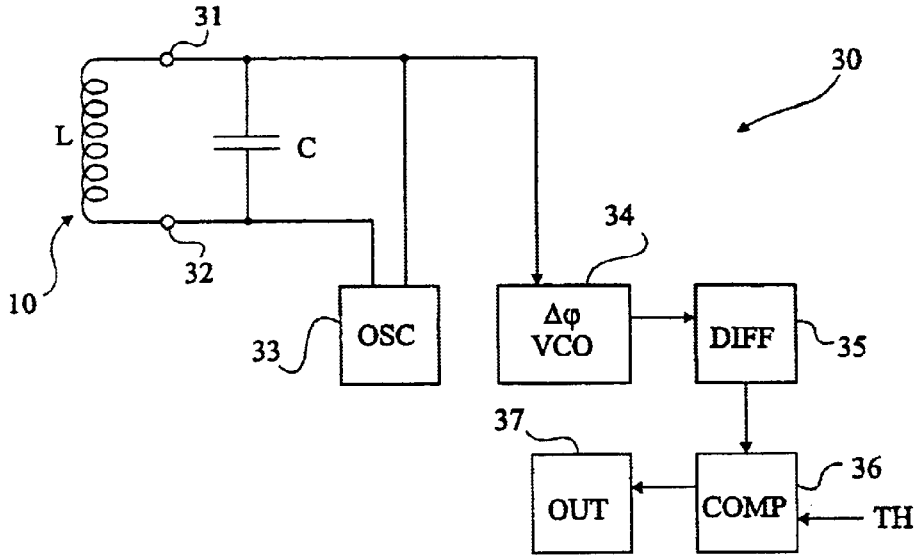
FIG. 3 shows, in the form of blocks, an embodiment of a circuit for exciting the sensor and exploiting the results according to the present invention.

FIG. 3 shows an embodiment of a device 30 for exciting a sensor 10 according to the present invention. This sensor is symbolized by an inductive resistor L having its terminals 31 and 32 corresponding to the ends of the winding (15, FIGS. 2A and 2B) connected to input terminals of device 30. The inductive element formed by the sensor is connected in parallel across a capacitor C to form a rejector circuit.

Device 30 includes an oscillator 33 (OSC) for exciting the rejector circuit. The dimensions of the winding (and thus of the corresponding inductive resistor L) and of capacitor C are chosen according to the desired rejector circuit excitation frequency. In practice, values are chosen according to the formula $1/2\pi\sqrt{LC}$. Device 30 also includes a phase-locked loop circuit (PLL) 34 having an input connected to one of terminals 31 or 32 of the rejector circuit. The function of circuit 34 is to provide a DC voltage which is a function of the frequency in the rejector circuit. Conventionally, circuit 34 is based on the use of a phase comparator ($\Delta\phi$) associated with a voltage-controlled oscillator (VCO). The output of circuit 34 is sent to a differentiator 35 having the function of suppressing slow variations of the frequency to enable self-regulation of the system. The output of differentiator 35 is connected to a first end of a comparator 36 having its second input receiving a threshold value TH. The output of comparator 36 provides the information corresponding to the presence or to the absence of a vehicle axle on the sensor. This information is provided to an output block 37 formed by any known means, for example, a relay, to be exploited by a conventional processing system. The voltage-controlled oscillator of circuit 34 is controlled by the frequency of the rejector circuit. The system then self-adapts to the slow frequency variations to only take into account abrupt variations due to the passing of an axle. Differentiator 35 avoids the taking into account of slow variations by comparator 36. Differentiator 35 may, in practice, be formed by a capacitor of strong value (for example, on the order of one millifarad). In FIG. 3, only the functional links between the different circuits have been shown. Their implementation is within the abilities of those skilled in the art based on the functional indications given hereabove.

The inductance variation of the rejector circuit which occurs in the presence of an axle passing over the sensor is on the order of 1/10,000. By exciting the rejector circuit at a frequency ranging between, for example, ten and some hundred kilohertz, it is easier to isolate the magnetic field variations due to the passing of an axle than in the conventional circuit. It should be reminded that, in a conventional circuit, it is necessary to detect frequency variations on the order of $10^{-6}$. The present invention improves by a factor 10 the wanted signal-to-general signal ratio of the system.

An advantage of using a ferrite element to concentrate the magnetic field is that this enables providing a magnetic field of shorter range, which is thus not responsive to the metallic mass of the vehicle, which is further away from the sensor with respect to the wheels.

Another advantage is that the sensor is less bulky than a conventional sensor. Indeed, as compared to a sensor formed of a simple winding such as that described, for example, in above-mentioned U.S. Pat. No. 5,614,894, the use of an air-gap and the fact that only the modifications of the field generated by the wire-mesh of the wheels are sensed enable providing a much narrower sensor.

Thus, a sensor according to the present invention preferentially has an elongated shape. In practice, an air-gap width ranging between 1 and 50 cm and, preferably, ranging between 2 and 10 cm, will be provided. The air-gap width in the ferrite structure depends on the roadway width and on the desired detection. It should be noted that, according to the present invention, the width to be provided for the air-gap is independent from the coil used to detect the magnetic signature of the vehicle.

Another advantage of the present invention is that the ferrite structure isolates the sensor from magnetic disturbances coming from its own protective sheathing 20 if said sheathing includes metal.

Figure 4:
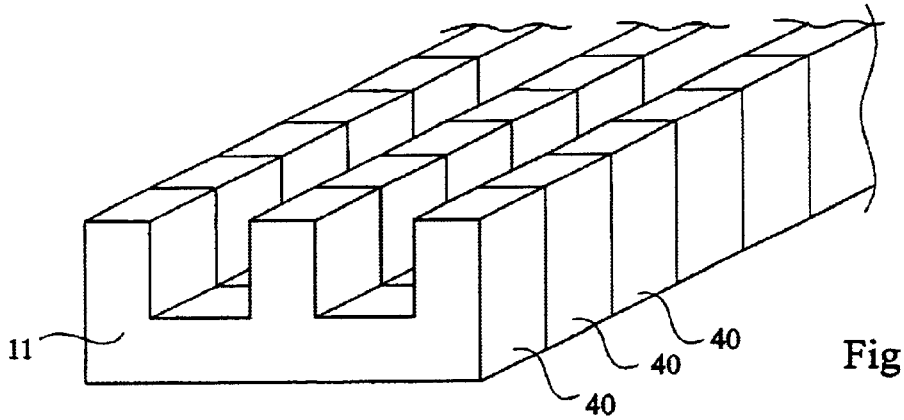
FIG. 4 is a partial perspective view of a preferred ferrite structure of a magnetic sensor according to the present invention.

FIG. 4 is a perspective view of a preferred embodiment of a ferrite structure 11 according to the present invention. This structure is formed of several ferrite elements 40, each having an E shape. These elements are put end to end, cross-section against cross-section, to form elongated structure 11.

An advantage of this embodiment is that elements 40 of small size, which are easily available for sale, may be used to form the elongated structure of the present invention.

According to an alternative embodiment, not all elements 40 are placed side by side, but a slight gap is left between some of them. This gap does not adversely affect the desired concentration of the magnetic field.

Figure 5:
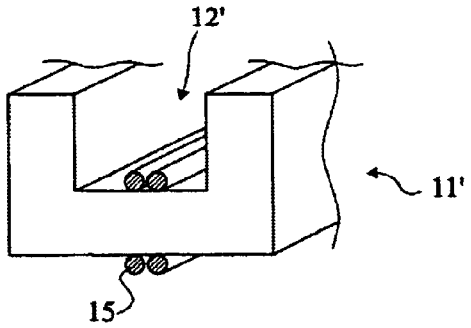
FIG. 5 shows an alternative embodiment of a magnetic sensor according to the present invention.

FIG. 5 shows, in a partial perspective view, a second embodiment of a ferrite structure 11' according to the present invention. In this embodiment, the ferrite structure has a U-shaped cross-section. Winding 15 is then wound around the portion forming the bottom of the U. Such a structure defines a single air-gap 12' for concentrating the magnetic field. This structure has the advantage of being simpler than that of FIG. 4 and of being less bulky, especially widthwise. However, an advantage of the structure of FIGS. 2 and 4 is that it forms a shielding of better quality against the rest of the roadway (under the sensor). Accordingly, the sensor is made less sensitive to metallic structures likely to exist in the roadway. In the embodiment of FIG. 5, the shielding is less efficient.

FIGS. 6A to 6D show, in very simplified top views, four embodiments of placing of a sensor according to the present invention in a roadway.

Figure 6A:
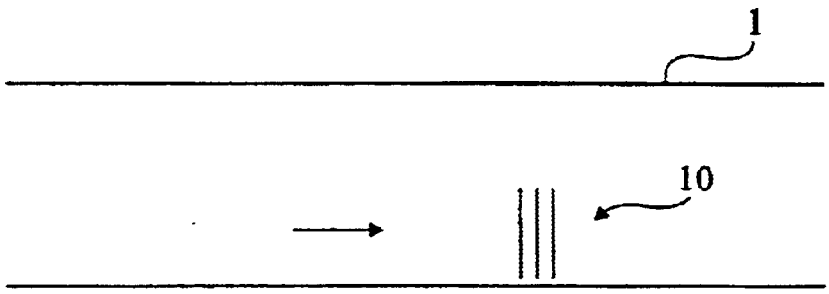
FIGS. 6A, 6B, 6C, and 6D very schematically show in top views different modes of positioning of a magnetic sensor according to the present invention in a roadway.

In the embodiment of FIG. 6A, sensor 10 is placed perpendicular to roadway 1. It does not extend across the entire roadway width, to only detect vehicles passing in the device implantation area.

Figure 6B:
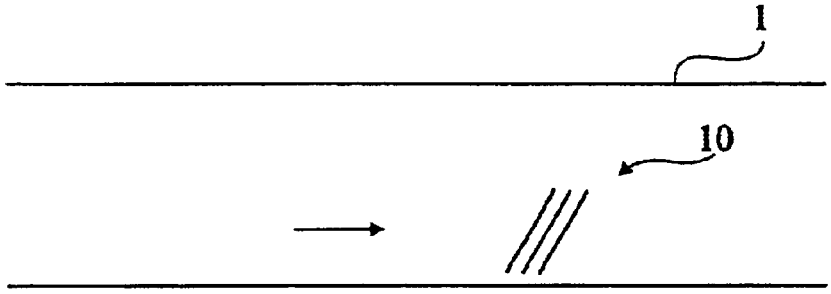

The embodiment of FIG. 6B shows a sensor 10 forming an angle smaller than 90° with respect to the direction of roadway 1.

Figure 6C:
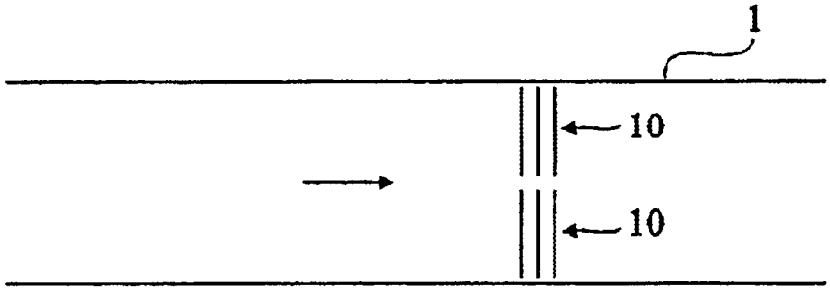

The embodiment of FIG. 6C shows a roadway 1 provided with two sensors aligned perpendicularly to the traffic direction. Such an embodiment is used, for example, to detect all vehicles passing through the channel. It may also be a roadway intended for the passing of vehicles in a single direction for which two-wheel vehicles are desired to be distinguished from the other vehicles.

Figure 6D:
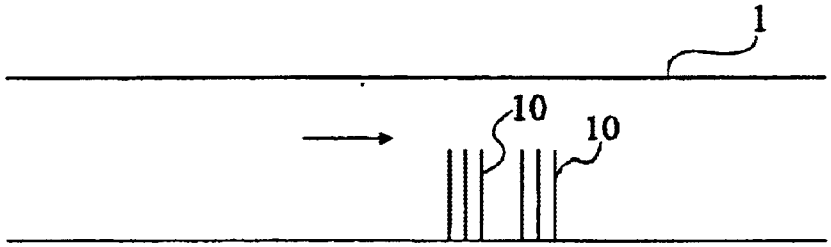

FIG. 6D shows a fourth embodiment in which two sensors are successively placed in the vehicle traffic direction. Such a device enables detecting the displacement direction of vehicles or their speed since the distance between the two sensors is known.

Of course, the present invention is likely to have various alterations, modifications, and improvements which will readily occur to those skilled in the art. In particular, the dimensions to be given to the sensor depend on its application and, in particular, on the width of the roadway in which it is to be implanted. Further, the burying depth of the sensor in the roadway also depends on the application, and more specifically on the desired field range. Said range will be set so that the sensor takes into account the wire-mesh of the wheels and not the metallic masses of vehicles. Further, the rejector circuit excitation frequency will be adapted to the application and, more specifically, to the type of vehicle wheels to be detected.

Finally, other detection circuits 30 may be provided, provided that the above-described functionalities and, especially, the choice of an excitation frequency enabling only detecting the wire meshes of the vehicle wheels without taking metallic masses into account, are respected. Finally, different ferrite structure shapes may be chosen according to the structures available for sale and to the desired magnetic isolation with respect to the rest of the roadway. If the air-gap is varied, the electronic parameters of the assembly may also be varied to keep the desired frequency areas. Its only function is to isolate the magnetic field from disturbing metal structures by closing up outside massive areas of the vehicle.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A magnetic sensor of the passing of at least one vehicle wheel adapted to being positioned on or in a roadway (1), comprising:

a conductive winding (15) of at least one turn and a ferrite structure (11) having an elongated surface, the conductive element being wound around a portion (16) of the ferrite structure, parallel to its greater dimension.

2. The sensor of claim 1, wherein the ferrite structure (11, 11') is positioned so that at least one air-gap (12, 13; 12') is directed towards the roadway surface.

3. The sensor of claim 1, wherein the ferrite structure (11) has an E-shaped cross-section, the conductive winding (15) being wound around the central branch (16) of the E.

4. The sensor of claim 1, wherein the ferrite structure (11') has a U-shaped cross-section, the conductive winding being wound around the bottom of the U or on one of the sides.

5. The sensor of claim 1, wherein the ferrite structure has a width ranging between 2 and 10 cm. and a length greater than 10 cm.

6. The sensor of claim 1, wherein the ferrite structure (11, 11') is formed of a succession of small elements (40) put end to end in the large dimension of the structure.

7. A vehicle wheel magnetic detector comprising:

a conductive winding (15) of at least one turn and a ferrite structure (11) having an elongated surface, the conductive element being wound around a portion (16) of the ferrite structure, parallel to its greater dimension; and an excitation and measurement exploitation circuit (30).

8. The detector of claim 7, wherein the circuit (30) comprises:

an oscillator (33) tuned to the parameters at rest of the conductive winding (15) associated with a capacitor (C); and a phase-locked loop (34), a voltage-controlled oscillator of which detects possible frequency variations in a rejector circuit formed of the conductive winding and of the capacitor.

9. The detector of claim 8, wherein the excitation frequency of the rejector circuit ranges between 10 and 100 kHz.

* * * * *